US008695255B2

(12) United States Patent
Anzalone

(10) Patent No.: US 8,695,255 B2
(45) Date of Patent: Apr. 15, 2014

(54) HOLDER FOR DISPLAYING A SHEET OF MATERIAL

(76) Inventor: Michael Joseph Anzalone, Centereach, NY (US)

( * ) Notice: Subject to any disclaimer, the term of this patent is extended or adjusted under 35 U.S.C. 154(b) by 410 days.

(21) Appl. No.: 12/725,045

(22) Filed: Mar. 16, 2010

(65) Prior Publication Data

US 2011/0225861 A1 Sep. 22, 2011

(51) Int. Cl.
*G09F 7/02* (2006.01)

(52) U.S. Cl.
USPC ..... 40/611.1; 7/164; 40/611.06; 40/661; 40/124.06; 40/737; 40/759; 362/364; 206/449

(58) Field of Classification Search
USPC ..... 40/653, 617, 611.01, 642.02, 661, 40/564–576, 377, 768
See application file for complete search history.

(56) References Cited

U.S. PATENT DOCUMENTS

| | | | | | |
|---|---|---|---|---|---|
| 1,894,803 | A | | 1/1933 | Wahlstrom | |
| 2,124,025 | A | * | 7/1938 | Braun | 40/642.02 |
| 2,176,535 | A | | 10/1939 | Markoff | |
| 2,309,407 | A | * | 1/1943 | McBeath | 40/653 |
| 3,142,920 | A | | 8/1964 | Nelson et al. | |
| 3,741,548 | A | | 6/1973 | Kaupp | |
| 3,838,529 | A | | 10/1974 | Aybar | |
| 3,981,092 | A | | 9/1976 | Ramsdale | |
| 4,602,447 | A | * | 7/1986 | Feingold | 40/405 |
| 4,643,452 | A | * | 2/1987 | Chang | 283/62 |
| 4,679,341 | A | | 7/1987 | Goldman | |
| 4,790,093 | A | * | 12/1988 | Ernest et al. | 40/661 |
| 5,189,822 | A | * | 3/1993 | Schmanski et al. | 40/611.05 |
| 5,526,597 | A | * | 6/1996 | Plotkin et al. | 40/722 |
| 5,555,977 | A | * | 9/1996 | Oshry et al. | 206/308.1 |
| 5,586,401 | A | * | 12/1996 | Sheehan et al. | 40/737 |
| 5,911,525 | A | | 6/1999 | Jepsen et al. | |
| 6,006,459 | A | | 12/1999 | Kosmach | |
| 6,119,381 | A | * | 9/2000 | Grocholski | 40/405 |
| 6,316,073 | B1 | | 11/2001 | Hiscock et al. | |
| D451,555 | S | | 12/2001 | Smith | |
| 6,374,523 | B1 | | 4/2002 | Smith | |
| 6,553,704 | B1 | | 4/2003 | Pigg | |
| 6,675,514 | B1 | * | 1/2004 | Salimes et al. | 40/447 |
| 6,745,509 | B1 | * | 6/2004 | Lapp | 40/661 |
| 6,792,710 | B2 | * | 9/2004 | Whitlow et al. | 40/768 |
| 6,986,422 | B2 | * | 1/2006 | Boatwright | 206/449 |

(Continued)

OTHER PUBLICATIONS

Swiss Re design drawings dated Nov. 16, 1996 (1 page).

(Continued)

*Primary Examiner* — Shin Kim
(74) *Attorney, Agent, or Firm* — Carter, DeLuca, Farrell & Schmidt, LLP

(57) ABSTRACT

A holder for displaying a sheet of material is provided. The holder includes a backplate, a lens, and a bracket. The bracket includes a frame defining at least one vertical wall bordering at least one inner wall. The at least one inner wall includes at least one connector for connecting to at least one corresponding connector of the lens for securing the lens to the bracket. A portion of the lens contacts a first wall of the at least one vertical wall and a first inner wall of the at least one inner wall. The backplate is secured to the bracket via at least one fastener. A portion of the backplate contacts a second wall of the at least one vertical wall and a second inner wall of the at least one inner wall.

16 Claims, 6 Drawing Sheets

(56) References Cited

U.S. PATENT DOCUMENTS

| | | | | |
|---|---|---|---|---|
| 7,055,275 | B1 | 6/2006 | Teza et al. | |
| 7,143,535 | B1 * | 12/2006 | Cobb et al. | 40/611.08 |
| 7,266,920 | B2 | 9/2007 | Kao | |
| 7,422,348 | B1 * | 9/2008 | Yates, II | 362/364 |
| 7,954,267 | B2 * | 6/2011 | Anzalone | 40/756 |
| 8,046,945 | B2 * | 11/2011 | Radcliffe | 40/737 |
| 2007/0180747 | A1 * | 8/2007 | Anzalone | 40/765 |

OTHER PUBLICATIONS

Mancini-Duffy Architectural Design (1 page).

* cited by examiner

HOLDER FOR DISPLAYING A SHEET OF MATERIAL

BACKGROUND

1. Technical Field

The present disclosure relates to display devices. More specifically, the present disclosure relates to a holder for displaying a sheet of material that may be customized for a particular purpose and then changed on an as needed basis.

2. Background of the Related Art

Display holders are used to display information, including advertising or name information. Furthermore, these holders must be able to receive and firmly secure the material received within the holder but also be easily changed if such material in the holder needs to be updated or amended. For example, with advertising material, it is sometimes desirable to change or update the information displayed or the sheet of material on a regular or as needed basis.

Accordingly, it is an aspect of the present disclosure to provide a holder suitable for displaying a sheet of material that can be customized for a particular purpose but also removed and replaced if such purpose has changed.

SUMMARY

A holder for displaying a sheet of material is disclosed having a backplate and a removable lens adjacent to the backplate. The backplate is secured to a bracket using at least one fastening member, such as a screw or rivet. The bracket includes a mechanism for supporting the lens and a sheet of material between the backplate and the lens. The mechanism includes at least one protrusion or peg configured and dimensioned for connecting to at least one connector of the lens and the sheet of material.

In particular, the holder includes a backplate, a lens, and a bracket. The bracket includes a frame defining at least one vertical wall bordering at least one inner wall. The at least one inner wall includes at least one connector for connecting to at least one corresponding connector of the lens for securing the lens to the bracket. A portion of the lens contacts a first wall of the at least one vertical wall and a first inner wall of the at least one inner wall. The backplate is secured to the bracket via at least one fastener. A portion of the backplate contacts a second wall of the at least one vertical wall and a second inner wall of the at least one inner wall.

According to the present disclosure, a kit is also provided. The kit includes a plurality of brackets, a plurality of backplates, and/or a plurality of lenses. The brackets, lenses and/or the backplates of the kit can be assembled in a plurality of combinations. Additionally, the brackets, lenses and/or the backplates of the kit can be tinted different colors, have difference sizes, etc. to enable the creation of a variety of visual effects and different assembled holders.

BRIEF DESCRIPTION OF THE DRAWINGS

Particular embodiments of the presently disclosed holder are described herein with reference to the drawings, wherein.

DETAILED DESCRIPTION

Figure 1:
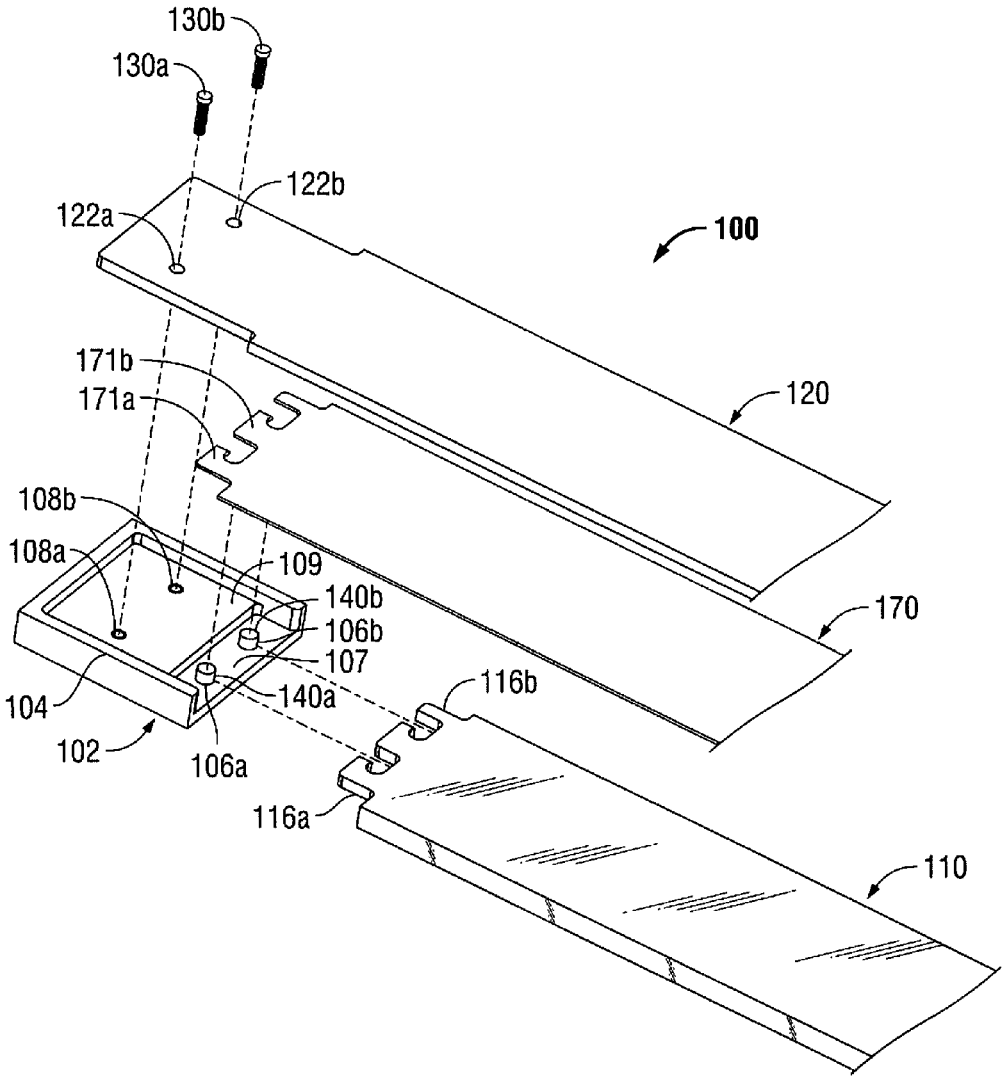
FIG. 1 shows an exploded perspective view of an embodiment of a holder for displaying a sheet of material in accordance with the present disclosure.

Embodiments of the a holder for displaying a sheet of material are described below in detail with reference to the drawings, in which like reference numerals designate identical or corresponding elements in each of the several views.

Referring to FIG. 1, there is shown an exploded view of a holder for displaying a sheet of material therein according to an embodiment of the present disclosure. The holder is generally identified by reference numeral 100. Holder 100 includes a bracket 102, a lens or front plate 110, and a backplate 120. The bracket 102 includes a frame 104 bordering on three sides an inner securing wall 109 and bordering on two sides an inner connecting wall 107.

The frame 104 defines a first vertical wall 103 bordering the inner securing wall 109 on the three sides. The frame further defines second vertical walls 105*a*, 105*b* on two opposing sides of the inner connecting wall 107. The second vertical walls 105*a*, 105*b* partially including the first vertical wall 103 and having substantially twice the width of the first vertical wall 103.

A third vertical wall 111 having substantially the same width as the first vertical wall 105 provides a separation between the inner connecting wall 107 and the inner securing wall 109. The bracket 102 further includes a fourth vertical wall 113 at an edge of the inner connecting wall 107. The inner connecting wall 107 is at a step-down configuration with respect to the inner securing wall 109.

Figure 2:
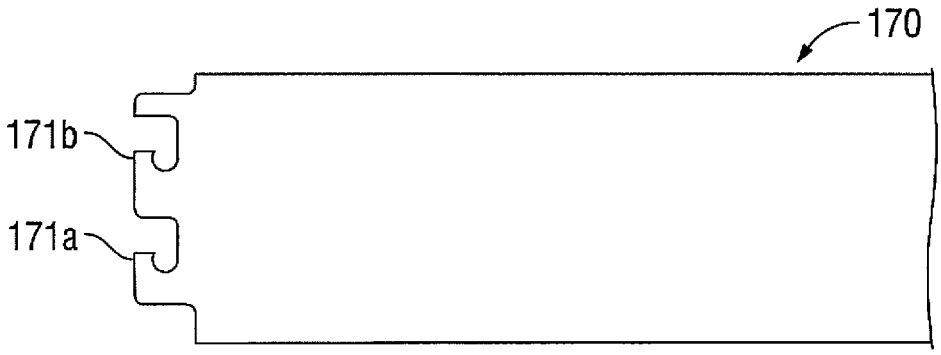
FIG. 2 shows a front view of a sheet of material capable of being displayed by the holder of FIG. 1.
Figure 3:
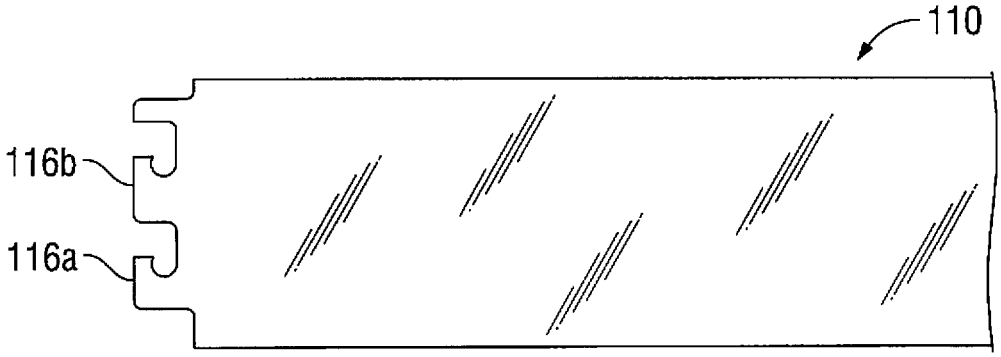
FIG. 3 shows a front view of a lens or front plate of the holder shown in FIG. 1.
Figure 4:
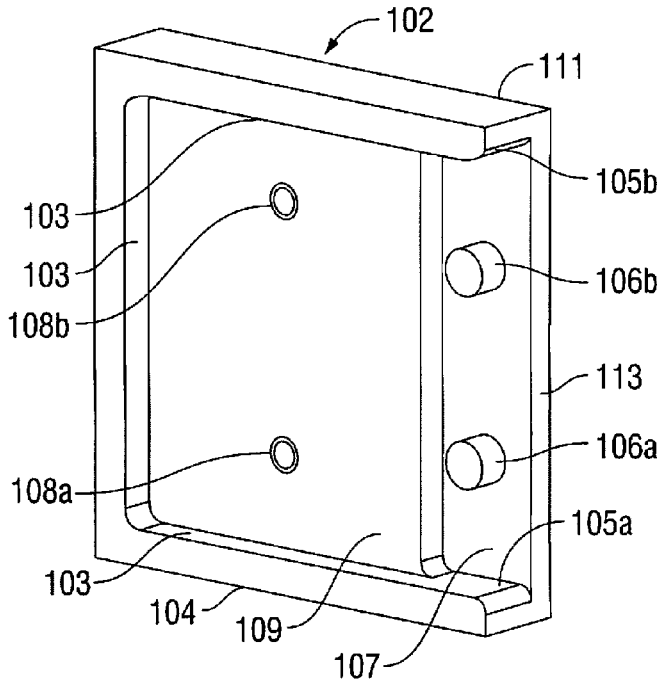
FIG. 4 shows a perspective view of a bracket of the holder shown in FIG. 1.
Figure 5:
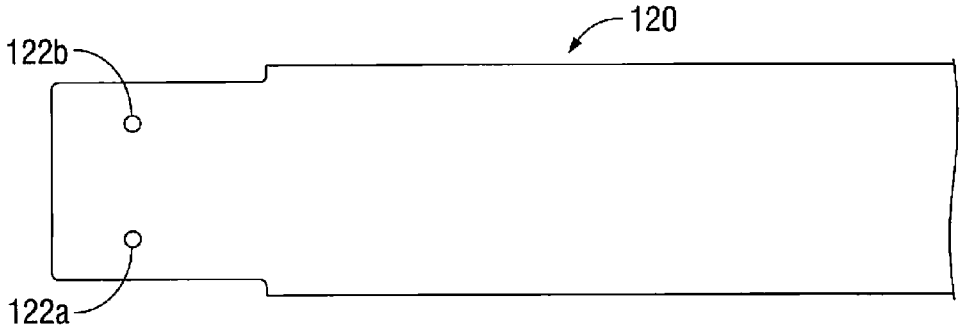
FIG. 5 shows a front view of a backplate of the holder shown in FIG. 1.

The connecting wall 107 of the bracket 102 includes two connectors, such as pegs or protrusions 106*a*, 106*b*, configured for being received by corresponding connectors, such as J-hooks 116*a*, 116*b*, of the lens 110 as further described below. The pegs 106*a*, 106*b* are also used for connecting thereto two J-hooks 171*a*, 171*b* (FIG. 2) provided on a sheet of material 170 for holding the sheet of material 170 as also further described below.

The bracket 102 further includes two openings 108*a*, 108*b* for attaching to the backplate 120 via two fastening members 130*a*, 130*b*, such as screws or rivets. The holder 100 is configured to be mounted to a support surface such as a wall, door, etc. via an adhesive, or one or more fastening members, such as screws, pins, etc.

Referring to FIGS. 2-6C, a discussion will now be presented regarding one method of assembly of the various components of the holder 100 shown in FIG. 1. First, the sheet of material 170 is mounted on the bracket 102 via pegs 106*a*, 106*b* being connected to J-hooks 171*a*, 171*b* of the sheet of material 170. Upon mounting to the bracket 120, a portion of the material 170 rests on connecting wall 107. The sheet of material 170 can be paper, metallic, plastic, or other type of material having indicia, text, pictures, logos, markings, codes, etc. thereon for display by the holder 100.

Second, the backplate 120 is fastened to the bracket 102 using fastening members 130*a*, 130*b* to form a bracket-backplate assembly. The fastening members 130*a*, 130*b* traverse openings 122*a*, 122*b* of the backplate 120 and are threaded or fitted within openings 108*a*, 108*b* of the bracket 102. Once the backplate 120 is fastened to the bracket 102, a portion of the backplate 120 rests against the inner securing wall 109 of the bracket 102 and is flush with respect to the frame 104 and the top surface of each peg 106.

Third, the lens 110 is mounted to the bracket-backplate assembly. Each of the J-hooks 116*a* and 116*b* of the lens 110 includes an opening for receiving therein a corresponding peg 106 of the bracket 102. The lens 110, after the pegs 106*a*, 106*b* are received within the openings of the J-hooks 116*a*, 116*b*, is slided or positioned towards a bottom portion of the connecting wall 107 against the second vertical wall 105*a* of the bracket 102. An edge of the lens 110 abuts the third vertical wall 111 and is flush with respect to the third vertical wall 111.

Figure 6A:
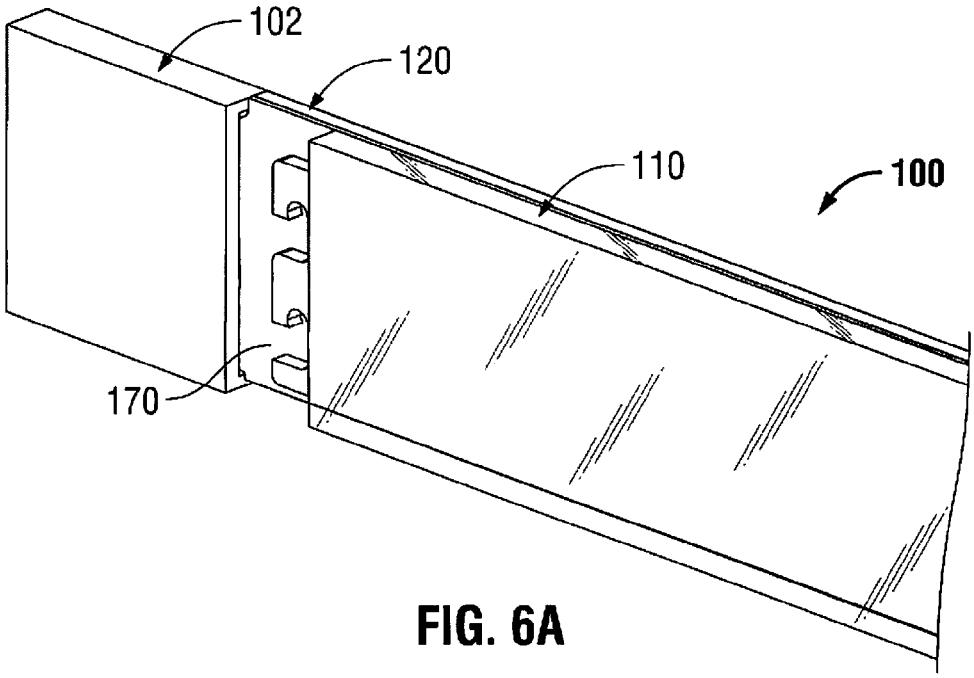
FIG. 6A shows a perspective view of the holder shown in FIG. 1 showing the lens removed from the bracket-backplate assembly.
Figure 6B:
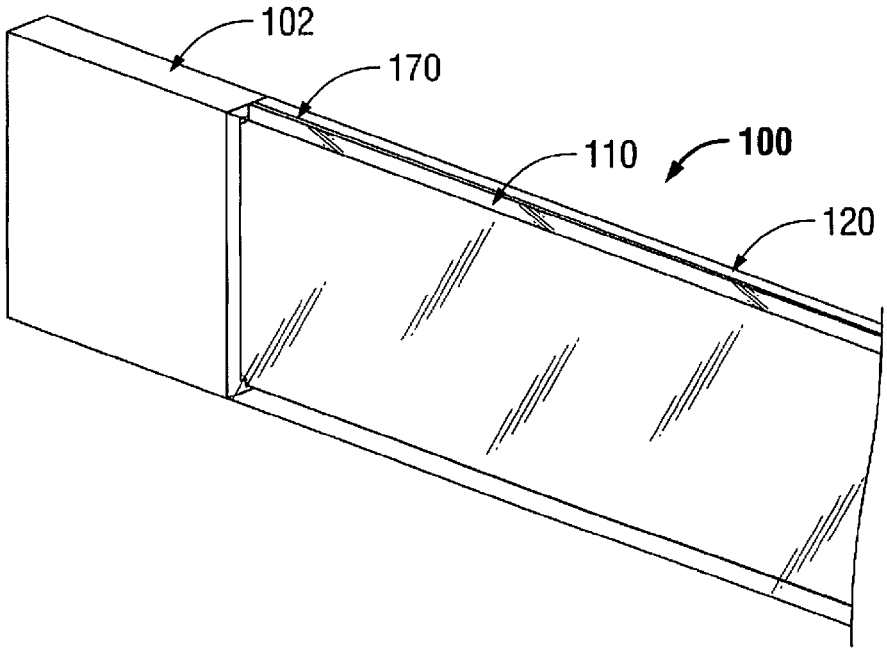
FIG. 6B shows a perspective view of the holder shown in FIG. 1 showing the lens supported or connected to the bracket-backplate assembly.
Figure 6C:
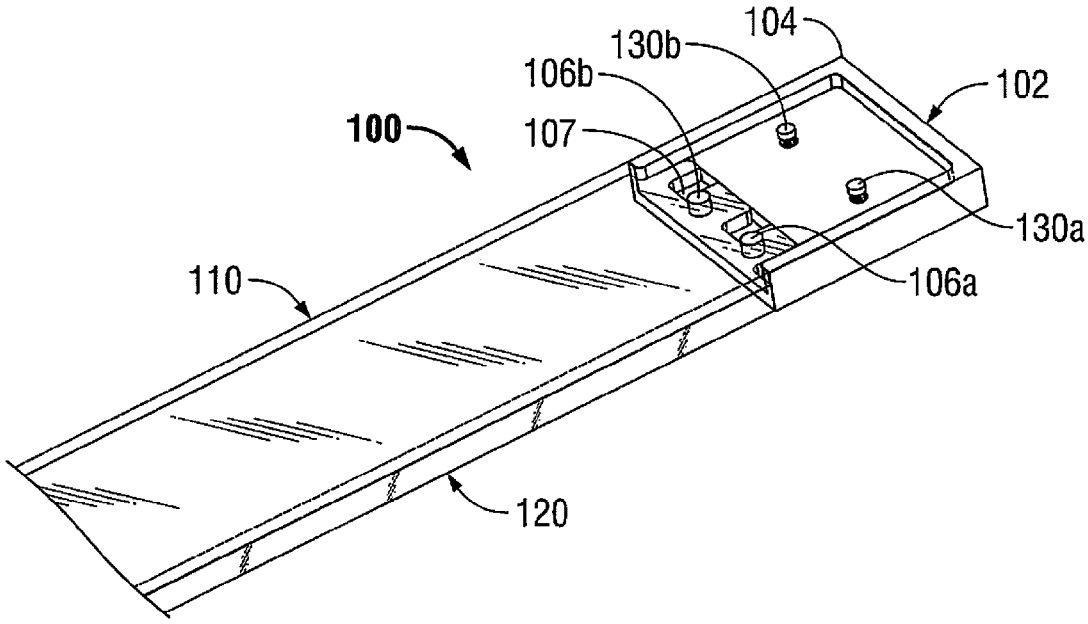
FIG. 6C shows a perspective view of the backside of the holder shown in FIG. 1 showing the connection of the lens to the bracket-backplate assembly.

When the holder 100 is fully assembled, each of the pegs 106*a*, 106*b* having outer surfaces 140*a*, 140*b* rests on a curved portion of a respective J-hook 116 as shown by FIG. 6C. A different connection mechanism, other than the J-hook 116 mechanism, can be provided to holder 100.

The lens 110 and/or sheet of material 170 can be easily removed from the bracket-backplate assembly without disconnecting the bracket-backplate assembly. The final assembly of the holder 100, as shown by FIGS. 6B and 6C, has the lens 110 substantially overlaying the backplate 120.

The lens 110 is constructed of a transparent material, such as plastic, acrylic, and glass, including transparent magnifying materials, as is necessary for viewing the sheet of material 170 between the lens 110 and the backplate 120. It is contemplated, however, that the lens 110 is constructed of other materials, including non-transparent materials, and that the lens 110 is provided with indicia, text, pictures, logos, markings, codes, etc. In this embodiment, the lens 110 acts as the display of indicia, text, pictures, logos, markings, codes, etc., and a sheet of material 170 does not have to be provided between the lens 110 and the backplate 120.

It is also contemplated that the lens 110 is provided with indicia, text, pictures, logos, markings, codes, etc., as well as the sheet of material 170 and/or the backplate 120. As a result, the lens 110 in combination with the sheet of material 170 and/or the backplate 120 acts as the display for the indicia, text, pictures, logos, markings, codes, etc. It is further contemplated that the backplate 120 is provided with indicia, text, pictures, logos, markings, codes, etc., as well as the sheet of material 170 and/or the lens 110. As a result, the backplate 120 in combination with the sheet of material 170 and/or the lens 110 acts as the display for the indicia, text, pictures, logos, markings, codes, etc.

The dimensions of the various components can be altered to provide holders 100 of various sizes to accommodate sheets of material 170 of various sizes, in accordance with the present disclosure and as described below with reference to FIG. 7. The sheet of material 170 can be customized to be the same or different size than the size of the lens 110, and/or also have J-hooks as the lens 110 for connecting to the pegs 106*a*, 106*b* of the bracket 102.

In accordance with the present disclosure, the holder 100 can be packaged as a kit having a plurality of brackets 102, a plurality of lenses 110, and/or a plurality of backplates 120. Each of the plurality of backplates 120 and lenses 110 can be tinted different colors, or be transparent, opaque, etc. enabling the user to remove the backplate 120 of the holder 100 and/or lens 110 and replace one or both with another backplate 120 or lens 110 provided by the kit.

Figure 7:
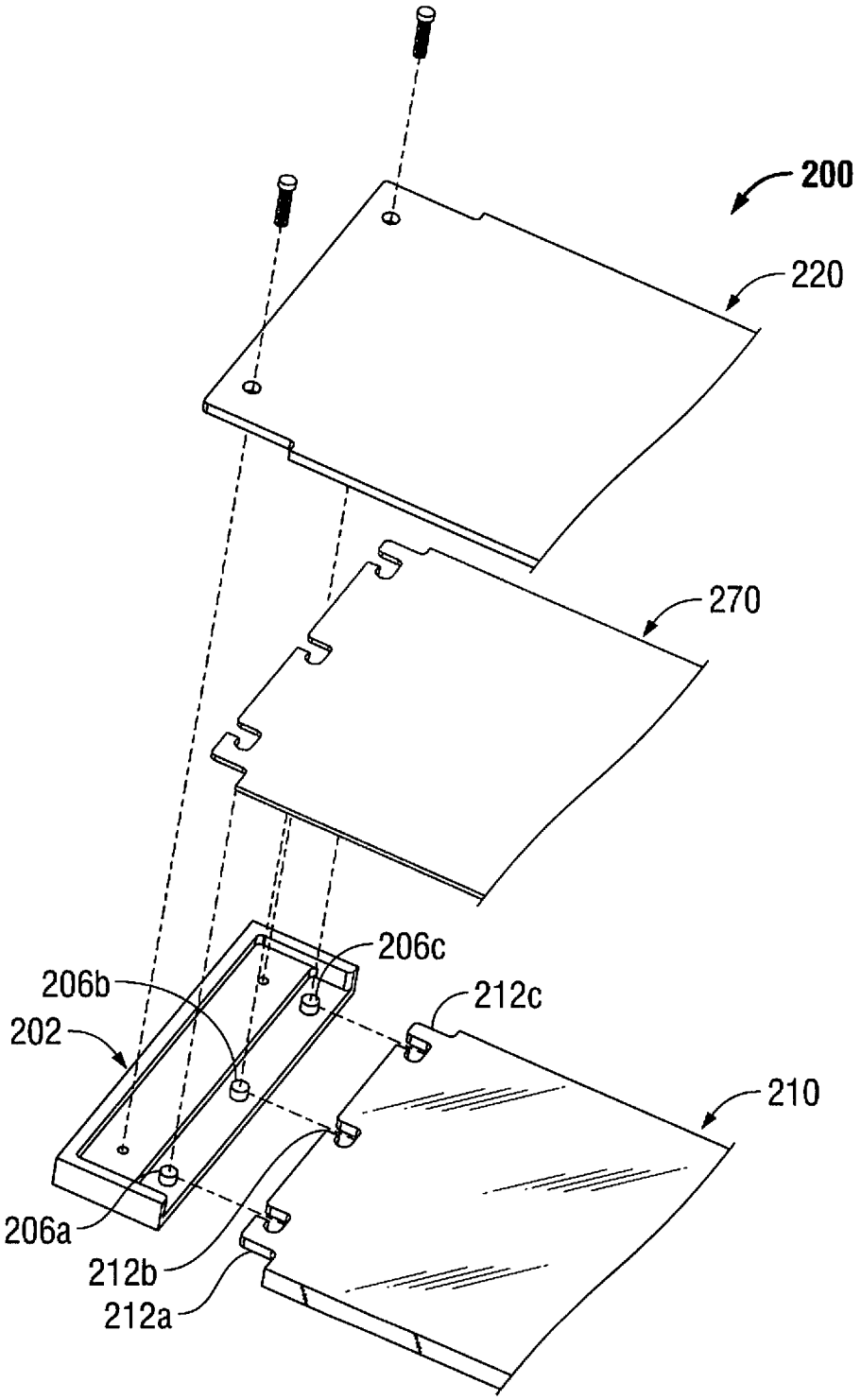
FIG. 7 shows an exploded perspective view of an alternate embodiment of a holder for displaying a sheet of material in accordance with the present disclosure.

With reference to FIG. 7, there is shown an exploded view of another holder 200 for displaying a sheet of material 270 according to the present disclosure. The holder 200 has features identical to holder 100 but a different size. The holder 200, as with holder 100, includes a lens 210 through which the sheet of material 270 can be viewed.

The lens 210 may be generally rectangular in shape and constructed from a transparent or non-transparent material as is necessary for viewing the sheet of material therethrough, and as described above with respect to lens 110. A backplate 220 is shaped to substantially correspond to the rectangular shape of the lens 210, and be mounted to a bracket 202 in a similar manner as described above with respect to backplate 120 and bracket 102.

The bracket of holder 200 has three pegs 206*a-c*, and the lens 210 of bracket 202 has three J-hooks 212*a-c* for respectively mounting to the three pegs 206*a-c* of the bracket 202.

It would be appreciated that various presently unforeseen or unanticipated alternatives, modifications, variations, or improvements therein may be subsequently made by those in the art which are also intended to be encompassed by the following claims.

What is claimed is:

1. A holder for displaying a sheet of material, the holder comprising:

a backplate;

a transparent or opaque member; and a bracket having a frame defining at least one vertical wall bordering at least one inner wall having at least one connector for connecting to at least one corresponding connector of the transparent or opaque member for securing the transparent or opaque member to the bracket, wherein a portion of the transparent or opaque member contacts a first wall of the at least one vertical wall and a first inner wall of the at least one inner wall, wherein the backplate is secured to the bracket via at least one fastener, wherein a portion of the backplate contacts a second wall of the at least one vertical wall and a second inner wall of the at least one inner wall, wherein, the transparent or opaque member includes six sides of which only one side of said six sides includes the at least one corresponding connector for securing the transparent or opaque member to said bracket, and wherein a top surface of the at least one connector of the bracket contacts the backplate.

2. The holder according to claim 1, wherein the at least one second inner wall is at a step-down configuration with respect to the at least one first inner wall.

3. The holder according to claim 1, further comprising a sheet of material configured for being received by the at least one connector of the at least one inner wall.

4. The holder according to claim 1, wherein the at least one connector of the transparent or opaque member is a J-hook and the at least one connector of the bracket is a protrusion configured to connect with the J-hook.

5. The holder according to claim 1, wherein the holder is packaged as a kit having at least one of a plurality of transparent or opaque members, a plurality of backplates, and a plurality of brackets.

6. The holder according to claim 1, wherein the at least one fastener is selected from the group consisting of screws and rivets.

7. The holder according to claim 1, wherein the frame borders the backplate and the transparent or opaque member on three sides.

8. A kit having components for constructing a plurality of holders for displaying a sheet of material, the kit comprising:

a backplate;

a plurality of transparent or opaque members; and a bracket configured for being secured to the backplate, said bracket having a frame defining at least one vertical wall bordering at least one inner wall having at least one connector for connecting to at least one corresponding connector of one of the plurality of transparent or opaque members for securing the one transparent or opaque member to the bracket, wherein each of the plurality of transparent or opaque members includes six sides of which only one side of said six sides includes the at least one corresponding connector of one of the plurality of transparent or opaque members for securing the one transparent or opaque member to said bracket, and wherein a top surface of the at least one connector of the bracket contacts the backplate.

9. The kit according to claim 8, wherein a portion of the one transparent or opaque member contacts a first wall of the at least one vertical wall and a first inner wall of the at least one inner wall, wherein the backplate is secured to the bracket via at least one fastener, and wherein a portion of the backplate contacts a second wall of the at least one vertical wall and a second inner wall of the at least one inner wall.

10. The kit according to claim 9, wherein the at least one second inner wall is at a step-down configuration with respect to the at least one first inner wall.

11. The kit according to claim 8, further comprising a sheet of material configured for being received by the at least one connector of the at least one inner wall.

12. The kit according to claim 8, wherein the at least one connector of the one transparent or opaque member is a J-hook and the at least one connector of the bracket is a protrusion configured to connect with the J-hook.

13. The kit according to claim 8, wherein the frame borders the backplate and the one transparent or opaque member on three sides.

14. The kit according to claim 9, wherein the at least one fastener is selected from the group consisting of screws and rivets.

15. A holder for displaying a sheet of material, the holder comprising:

a backplate;

a transparent or opaque member; and a bracket having a frame defining at least one vertical wall bordering at least one inner wall having at least one connector for connecting to at least one corresponding connector of the transparent or opaque member for securing the transparent or opaque member to the bracket, wherein a portion of the transparent or opaque member contacts a first wall of the at least one vertical wall and a first inner wall of the at least one inner wall, wherein the backplate is secured to the bracket via at least one fastener, wherein a portion of the backplate contacts a second wall of the at least one vertical wall and a second inner wall of the at least one inner wall, wherein the transparent or opaque member includes six sides of which only one side of said six sides is configured for connecting to said bracket, and wherein the at least one connector of the transparent or opaque member is a J-hook and the at least one connector of the bracket is a protrusion configured to connect with the J-hook.

16. A kit having components for constructing a plurality of holders for displaying a sheet of material, the kit comprising:

a backplate;

a plurality of transparent or opaque members; and a bracket configured for being secured to the backplate, said bracket having a frame defining at least one vertical wall bordering at least one inner wall having at least one connector for connecting to at least one corresponding connector of one of the plurality of transparent or opaque members for securing the one lens to the bracket, wherein each of the plurality of transparent or opaque members includes six sides of which only one side of said six sides is configured for connecting to said bracket, and wherein the at least one connector of the one lens is a J-hook and the at least one connector of the bracket is a protrusion configured to connect with the J-hook.

* * * * *